United States Patent [19]

Dygve

[11] Patent Number: 5,056,543

[45] Date of Patent: Oct. 15, 1991

[54] DEVICE FOR DRYING DISHES IN A DISHWASHER

[75] Inventor: Hans G. E. Dygve, Huskvarna, Sweden

[73] Assignee: Aktiebolaget Electrolux, Stockholm, Sweden

[21] Appl. No.: 470,914

[22] Filed: Jan. 26, 1990

[30] Foreign Application Priority Data

Feb. 3, 1989 [SE] Sweden ..... 8900380

[51] Int. Cl.[5] ..... A47L 15/48

[52] U.S. Cl. ..... 134/107; 34/73; 134/182

[58] Field of Search ..... 134/95, 107, 182; 68/20; 34/32, 34, 73, 232, 235; 312/213, 214, 228

[56] References Cited

U.S. PATENT DOCUMENTS

| | | | |
|---|---|---|---|
| 2,858,688 | 11/1958 | Smith | 68/20 |
| 3,024,074 | 3/1962 | Jacobs et al. | 134/107 X |
| 3,170,743 | 2/1965 | Martiniak | 312/213 |
| 3,193,340 | 7/1965 | Braden | 312/213 |
| 3,616,810 | 11/1971 | Ter Bush | 34/73 X |
| 3,876,469 | 4/1975 | Schimke | 134/95 |

FOREIGN PATENT DOCUMENTS

| | | |
|---|---|---|
| 1926049 | 5/1969 | Fed. Rep. of Germany . |
| 2491322 | 4/1982 | France . |
| 1245570 | 9/1971 | United Kingdom . |

*Primary Examiner*—Philip R. Coe

*Attorney, Agent, or Firm*—Pearne, Gordon, McCoy & Granger

[57] ABSTRACT

A device to be utilized for drying dishes in a dishwasher. The tub of the dishwasher communicates with the atmosphere via an open passageway comprising a condensation chamber (12, 14) which is placed outside and at a distance from the outer surface of the tub.

4 Claims, 1 Drawing Sheet

DEVICE FOR DRYING DISHES IN A DISHWASHER

BACKGROUND OF THE INVENTION

The present invention relates in general to dishwashers and more particularly to an improved device for drying dishes in a dishwasher.

PRIOR ART

When using a dishwasher it is desirable to be able to remove the dishes from the machine completely dry. In order to dry the dishes, heat is supplied at the end of the dishwashing cycle by means of an element which is heated by electricity. The moisture which is present in the tub is taken up by the warm air which is then vented to the ambient air or condensed.

By venting the air between the tub and an outer surrounding shell of the machine, which is a common method, there is a risk of corrosion problems, since the moisture condenses on different metal parts of the machine. If the vent passageway ends outside the machine and the machine is placed in an open area, there is a risk of injuries because of the outflowing hot, moisture-saturated air. If, on the other hand, the vent passageway is hidden in a built-in arrangement outside the machine, there is a risk of moisture precipitation on interior fittings and under the work top.

It is also known to use separate interior means for condensing the water, see, i.e., DE 1,962,049; FR 2,491,322; and GB 1,245,570. However these systems are rather complicated, since they require a water supply, pumps, fans, and channel means to direct the flow of air to certain areas.

Another condensation method which is very simple and which is used frequently is to allow the air to self-circulate in the tub. This causes the water to condense on the cold tub walls. The condensate flows down from the walls and is collected in a sump at the bottom of the tub, from which the water then is removed by activating the drain pump. It is, however, difficult to keep the walls of the tub as cold as necessary, since the tub normally is surrounded by a sound-absorbing layer, which also acts as a heat-insulation layer against the surrounding colder air.

It is also common to use a combination of the methods mentioned above.

Moreover, if the machine is not equipped with a vent passageway for the heated air, the machine has to be provided with an opening to the atmosphere, in order to equalize the pressure which is created when the lid is moved to its closed position or when the water is heated. It is also a fact that if the tub is made of plastic, it is not possible to use relatively high power for the heating element during the drying phase, since the heat could damage the plastic material.

SUMMARY OF THE INVENTION

In accordance with the present invention, a device for a dishwasher comprising a tub in which liquid is circulated for cleaning dishes in the tub is disclosed. The tub communicates with the atmosphere via an open passageway, wherein the passageway forms a condensation chamber which is placed outside and at a distance from the outer surface of the tub. The device is simple and reliable, works according to the condensation model, and also equalizes pressure. It does not necessarily have a heat supply during the drying cycle. Cooling of the air is so effective that almost all moisture is precipitated as a condensate within the machine.

A preferred embodiment of the present invention is described in the following specification with reference to the accompanying drawings.

DESCRIPTION OF THE PREFERRED EMBODIMENT

Figure 1:
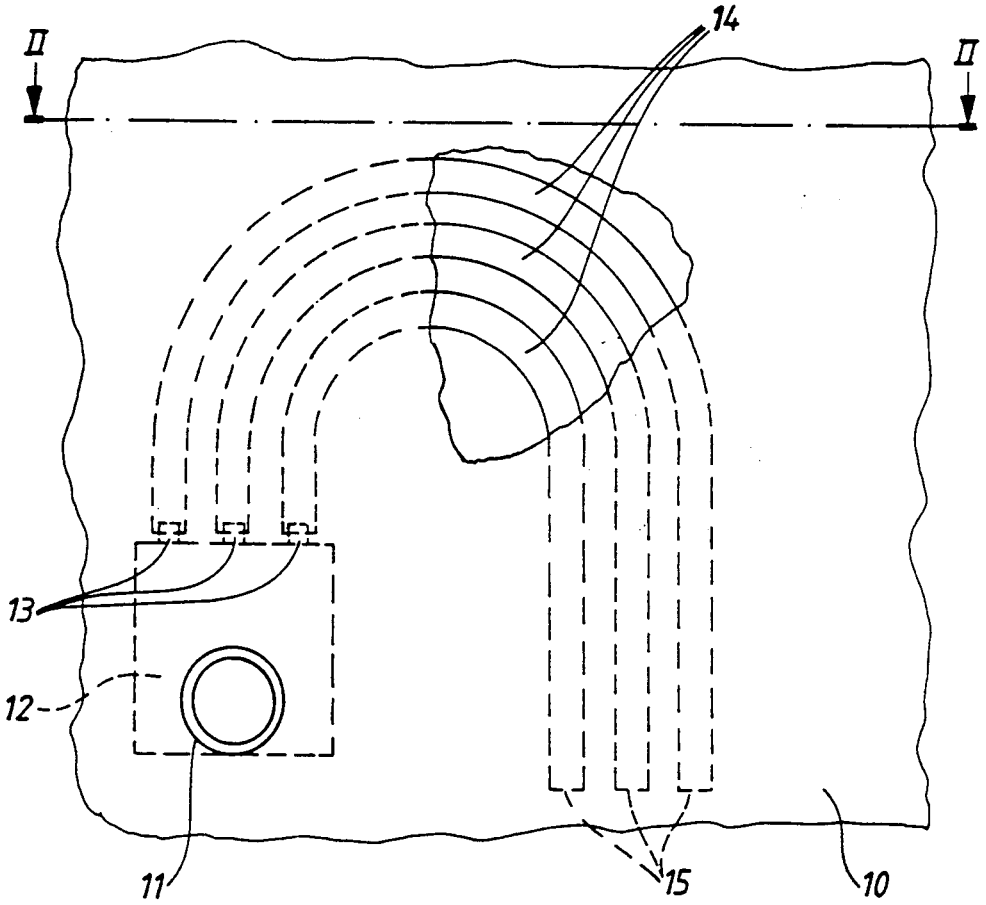
FIG. 1 is a partially cut-away vertical projection of the tub wall seen from the inside.
Figure 2:
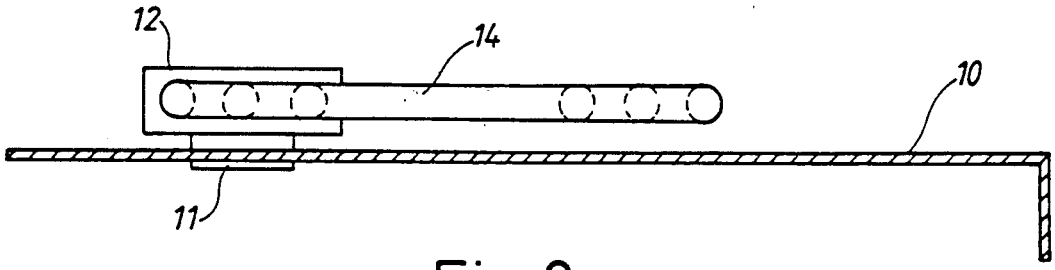
FIG. 2 is a sectional view taken along line II—II in FIG. 1.

With reference to FIGS. 1 and 2, there is shown one of the vertical walls 10 in the tub of the dishwasher. The wall has an opening through which a tube 11 is inserted. This tube is a part of a box 12 placed outside the tub, the box at its upper part having three sleeves 13 to which three hoses 14 are fastened. The hoses 14 each have a U-shaped portion which, in the embodiment shown in FIGS. 1 and 2, each have a different radius of curvature so that they can be placed in the same vertical plane. Each hose also has an outlet opening 15 which is placed below the tube 11. The tube 11, box 12, as well as the hoses 14 are preferably made of plastic. The box 12 and the hoses 14 together form a condensation chamber.

Figure 3:
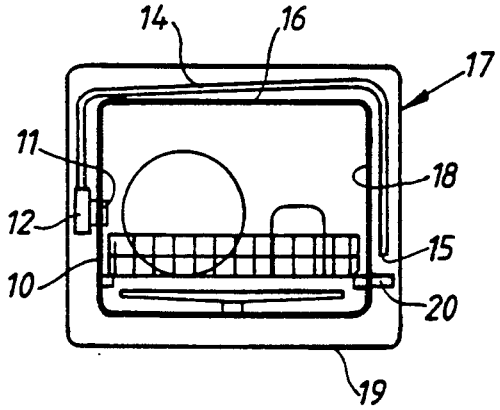
FIG. 3 is a diagrammatic front view of another embodiment of the invention with an associated lid open.

In the arrangement shown in FIG. 3 the box 12 is placed outside one of the vertical tub walls 10. The hoses 14, however, are placed above the roof part 16 of the tub and continue down between the outer cover 17 and the second side wall 18 of the tub, so that the hoses end above the bottom plate 19 of the cover. The hoses 14 are preferably placed so that the largest possible length slopes toward the box 12. In order to take care of the few drops of water which could be the result of condensation in the end part of the hoses there is a plate of plastic or a small plastic container 20 below the openings 15 from which the water easily evaporates.

The device operates in the following way. The heated dishwater in the tub during the dishwashing procedure transfers its heat to the walls of the tub and to the dishes. When the dishwater is emptied, the surrounding tub walls will cool, as a result of which the steam which is present in the tub is partly precipitated as water droplets on these walls. The droplets flow down the walls and are collected in the sump at the bottom of the tub.

Since the tub, via the tube 11, is vented to the ambient air, a part of the heated, moist air will flow through the box 12 and further through the hoses 14 to the outlet openings 15, from which it will continue into the space between the tub and the outer cover 17 of the machine or to the surrounding interior fittings. When the air passes the box 12 and flows to the highest point of the hoses 14, the moisture will condense on the surrounding surfaces and will return through the hoses 14 back to the box 12, from which it, by means of the tub 11, is returned to the sump of the tub. The air which flows out through the openings 15 will thus be effectively dehumidified. Because the box 12 as well as the hoses 14 are placed at a distance from the wall of the tub, the surfaces surrounding the flowing humid air will be cooled effectively by the ambient air. Thus by the suggested arrangement it is possible to compensate for the fact that the tub wall will cool less effectively when the sound insulation of the tub is increased, and also for the fact that the tub wall will cool less effectively when it has lower thermal conductivity, such as when the tub is made of plastic instead of metal.

It should be observed that the results of the drying procedure are guided, to a large extent, by the temperature of the final rinse water. The higher the temperature, the better the drying result. Even if this invention is primarily intended to be used without additional heating during the drying procedure, it is, of course, possible to use said arrangement also in combination with such a heating procedure. It is also possible, within the scope of the invention, to vary the shape of the condensation chamber within wide limits, i.e., by using a different number of hoses, or an integrated box and hoses, and so on.

Although the preferred embodiment of this invention has been shown and described, it should be understood that various modifications, replacements, and rearrangements of the parts may be resorted to without departing from the scope of the invention as described and claimed herein.

What is claimed is:

1. In a dishwasher having a tub with a floor, a roof and sidewalls, a heated liquid being circulated within said tub to clean dishes contained therein, the improvement comprising:

passageway means establishing fluid communication between the interior of said tub and the ambient atmosphere for venting at least a portion of the heated, moist air developed within said tub, said passageway means including a conduit extending from a sidewall of said tub and continuing above said roof, said conduit being spaced from the outer surface of said tub and leading to the exterior of said tub after continuing above said roof, said conduit defining a condensation chamber which condenses moisture from the heated moist air passing therethrough.

2. A dishwasher according to claim 1, wherein said conduit has the shape of an upside-down U extending over the roof and along the sidewalls of said tub.

3. A dishwasher according to claim 1, including additional conduits extending in parallel relationship to said conduit and each other, said passageway means further including a boxlike structure forming a part of said condensation chamber means and connecting common ends of said conduits with said tub.

4. A dishwasher according to claim 1, wherein said conduit also extends downwardly from said roof and along and in spaced relationship from another sidewall of said tub.

* * * * *